United States Patent [19]

Weidner et al.

[11] Patent Number: 4,922,576

[45] Date of Patent: May 8, 1990

[54] HANDLE FOR APPLIANCES

[75] Inventors: Timothy B. Weidner, Wyoming; Jeffery L. Salisbury, Greenville, both of Mich.

[73] Assignee: White Consolidated Industries, Inc., Cleveland, Ohio

[21] Appl. No.: 314,718

[22] Filed: Feb. 23, 1989

[51] Int. Cl.[5] ..... E05B 1/00

[52] U.S. Cl. ..... 16/114 R; 16/110 R; 16/110.5; 16/124; 16/DIG. 19; 312/214; 312/320; 312/138.1; 220/94 R

[58] Field of Search ..... 16/110 R, 110.5, 114 R, 16/114 A, 111 R, 124, 116 R, 125, DIG. 12, DIG. 18, DIG. 19; 74/558.5, 543; 312/214, 244, 320; 49/460; 220/94 A, 94 B, 94 R; 190/39, 115, 116, 117

[56] References Cited

U.S. PATENT DOCUMENTS

| | | | |
|---|---|---|---|
| 2,222,220 | 11/1940 | Morgan | 16/111 R |
| 3,648,411 | 3/1972 | Saunders et al. . | |
| 3,766,598 | 10/1973 | Roberts . | |
| 3,995,349 | 12/1976 | Roberts et al. . | |
| 4,087,141 | 5/1978 | Roberts . | |
| 4,261,078 | 4/1981 | Edwards et al. | 190/39 |
| 4,280,247 | 7/1981 | Burzen et al. | 190/115 |
| 4,713,860 | 12/1987 | Mobley et al. | 16/114 R |
| 4,745,656 | 5/1988 | Revlett . | |

FOREIGN PATENT DOCUMENTS

| | | | |
|---|---|---|---|
| 1512444 | 12/1966 | France | 16/110 |
| 854319 | 11/1960 | United Kingdom | 16/125 |

*Primary Examiner*—Nicholas P. Godici
*Assistant Examiner*—Edward A. Brown
*Attorney, Agent, or Firm*—Pearne, Gordon, McCoy & Granger

[57] ABSTRACT

A two-piece door handle for refrigerators and freezers is mounted on the edge of the doors by two fasteners. The handle includes a plastic molded part and a metal stamping. The plastic molded part provides a recess in which the entire metal stamping is positioned. Shoulders surrounding the recess engage all of the edges of the metal stamping, obscuring them from view and preventing user contact with such edges. The recessing of the metal stamping eliminates the need to provide a finish coating on the edges of the metal stamping. The molded plastic part provides a mounting flange portion positioned between a mounting flange portion on the metal stamping and the associated door. Therefore, metal-to-metal contact is prevented. The two pieces of the handle are easily snapped together as an assembly and are easily installed on the associated door.

5 Claims, 3 Drawing Sheets

HANDLE FOR APPLIANCES

BACKGROUND OF THE INVENTION

This invention relates generally to handle structures, and more particularly to a novel and improved appliance door handle structure.

PRIOR ART

Various types of handle structures for appliances such as refrigerators are known. Generally, in the past, such handles consisted of a relatively large number of pieces which had to be assembled and installed on a refrigerator door. Production and installation costs of such handles, to a great extent, are a function of the number of parts that must be manufactured, then assembled, and then installed. Further, when the refrigerator provided two doors, the handle costs were further increased. Examples of such door handles are illustrated in U.S. Pat. Nos. 3,648,411; 3,766,598; 3,995,349; 4,087,141; and 4,745,656.

It is also known to provide a refrigerator door handle formed of a one-piece stamping and a one-piece plastic, molded part. Such handle, formed of only two pieces, has been mounted by means of two screw fasteners along a door edge. The sheet metal stamping provided a flange which extended along an edge surface of the door and a U-shaped portion extended around three sides of a gripping portion on the plastic part. As assembled, the handle provided two lateral legs extending from the ends of the gripping portion which cooperated with the mounting flange and gripping portion to define a hand opening. In many instances, the flange portion of the metal stamping has been mounted directly on the associated door, resulting in metal-to-metal mounting. In other instances, such handle has been mounted over a separate nonmetallic seating element which fits under the mounting flange and around the counter of the door. Such two-piece handle has been marketed by the assignee of the present invention.

SUMMARY OF THE INVENTION

The present invention provides an improvement on the two-piece refrigerator door handle described above. The illustrated emboiment, like such prior two-piece handle, comprises a one-piece metal stamping and a one-piece molded plastic part. The assembled handle again provides a mounting flange, a gripping portion, and legs extending laterally from the gripping portion. Here again, the flange cooperates with the gripping portion and the legs to define a hand opening.

The present invention, however, provides several improvements over this prior two-piece handle. One improvement involves the provision of an integral mounting flange portion on the molded plastic part. The plastic flange portion is positioned between the metal flange portion and the surface of the appliance on which the handle is mounted. Therefore, the metal stamping does not contact the surface of the appliance (which is usually metal) and a metal-to-metal contact is avoided. This tends to reduce the tendency for damage to the surface finish of the stamping and the surface finish of the appliance.

Further, the fasteners which secure the handle to the appliance pass through both the flange portion of the stamping and the flange portion of the plastic molded part. The mounting fasteners assist in holding the two parts together.

Still further, the plastic molded parts provide a recess sized and structured to receive the entire metal stamping. Surrounding such recess are shoulders or walls which enclose the entire edge of the metal stamping. This conceals such edge from view. Therefore, the edges of the metal stamping need not be provided with a special finish for aesthetic purposes.

Further, adjacent to the shoulder or walls of the plastic part is a border structure which surrounds the entire metal stamping. Preferably, the exposed surface of the metal stamping and the surface of the molded plastic part are contrasting in color so that a contrasting and attractive border appearance is provided.

Still further, the shoulder or wall engages the edges of the metal stamping completely around the hand opening to provide an improved interconnection between the two handle parts.

In addition, the shoulder or wall enclosing the edges of the metal stamping is sized so that the surrounding surface of the molded plastic part is at least flush with the exposed surface of the metal stamping. Therefore, a substantially smooth exterior surface is provided and a user cannot be injured by edge imperfections which may exist along the edges of the metal stamping.

In the illustrated embodiment, the metal stamping is formed of cold-rolled steel sheet material on which an attractive vinyl sheet material is laminated prior to blanking and shaping of the metal stamping. Therefore, the edges of the metal part are not coated. Because the metal stamping is positioned in a recess in the molded plastic part, the edges are obscured from view and the user is protected from injurious contact with such edges.

The two parts of the handle cooperate to provide a low-cost, easily installed appliance handle. The handle provides an attractive appearance and the metal and plastic parts cooperate to provide a strong and durable structure.

These and other aspects of this invention are illustrated in the accompanying drawings, and are more fully described in the following specification.

DETAILED DESCRIPTION OF THE DRAWINGS

Figure 1:
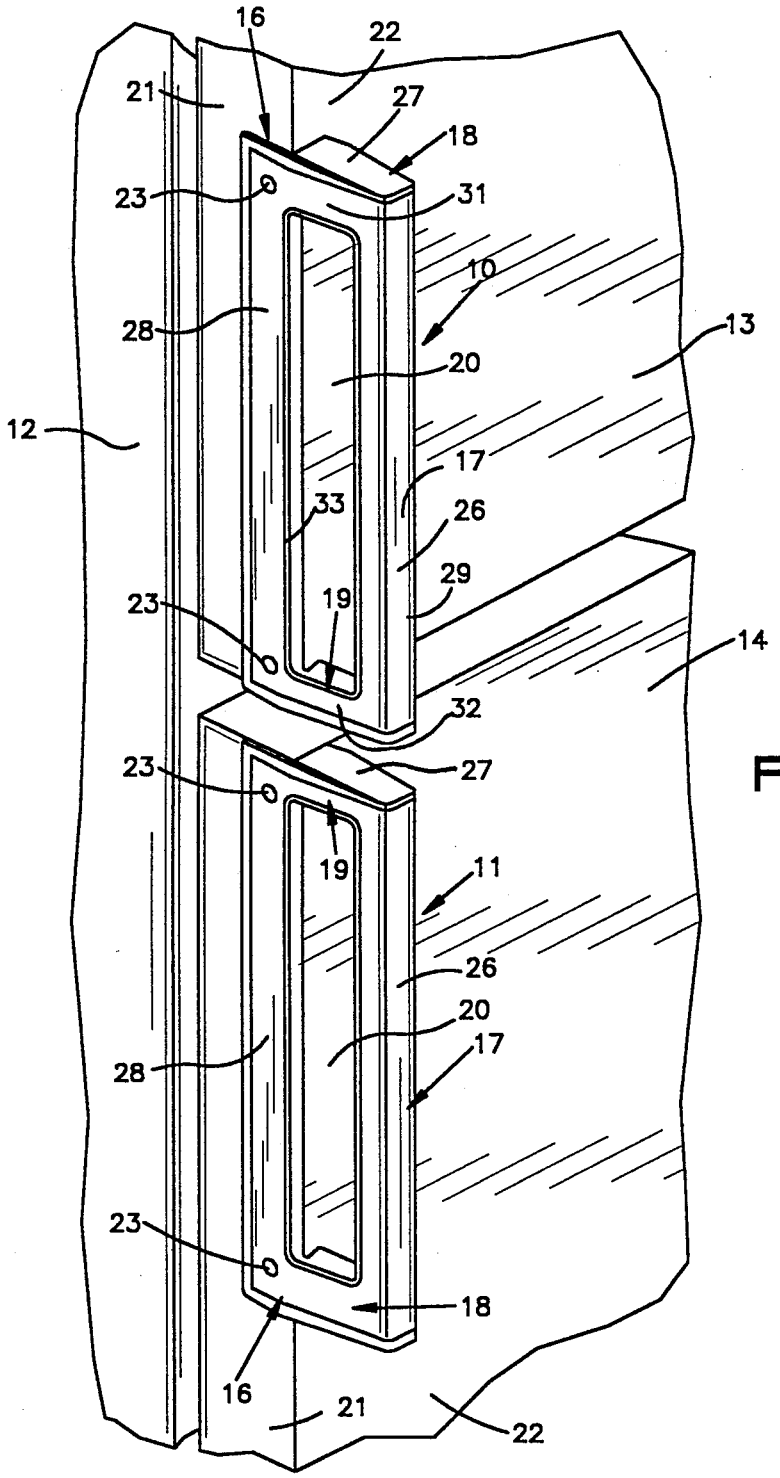
FIG. 1 is a perspective view of handles in accordance with the present invention, installed on a two-door refrigerator.

FIG. 1 illustrates a typical two-door refrigerator having door handles 10 and 11 mounted thereon. The refrigerator provides a cabinet 12 and two doors 13 and 14 mounted thereon. Typically, the upper door 13 provides access to a freezer compartment and the lower door 14 provides access to the food storage compartment of the refrigerator. Each of the door handles provides a mounting flange assembly 16, a gripping assembly 17, and lateral leg assemblies 18 and 19 which extend between the ends of the gripping assembly 17 and the mounting flange assembly 16. Such legs cooperate with the mounting flange assembly and gripping assembly to define a hande opening 20 through which the user's fingers project when the handles are gripped for opening and closing the associated doors.

The leg assemblies 18 of the handles have a greater vertical height than the leg assemblies 19 to provide aesthetic balance, since the two leg assemblies 19 are adjacent to each other. The two handles are mirror opposites in a vertical sense and, aside from that difference, are identical. Therefore, a detailed description of the handle 10 applies equally to the handle 11.

In each case, the mounting flanges 16 of the handles are positioned against the edge surface 21 of the associated door adjacent to the face surface 22 thereof. Fasteners 23 extend through the mounting flanges 16 into the door structure to secure the handles on the associated doors. This mounting eliminates the need for fastener openings in the face surface 22.

Figure 2:
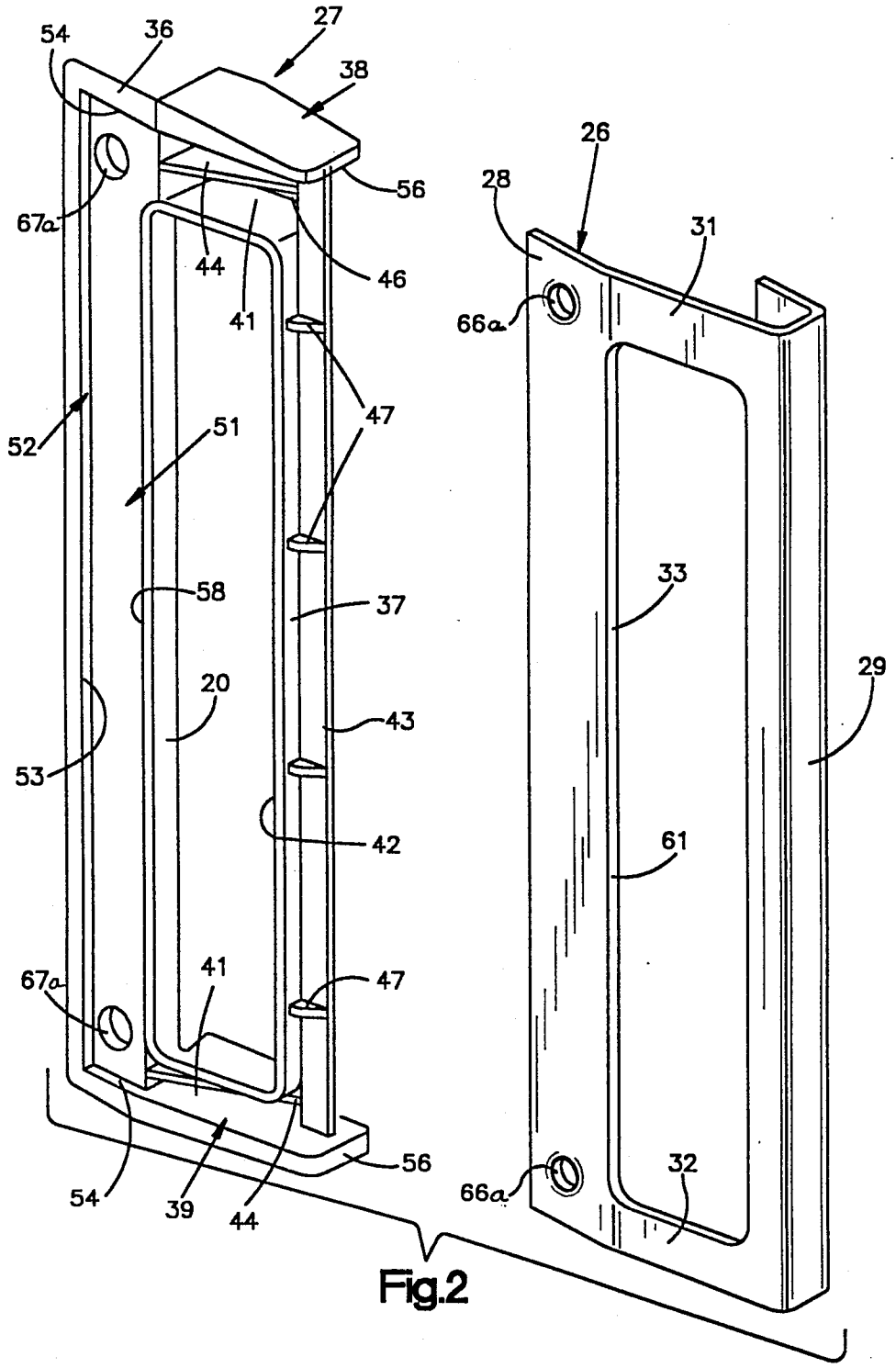
FIG. 2 is a perspective view of the two parts of the handle prior to assembly.
Figure 3:
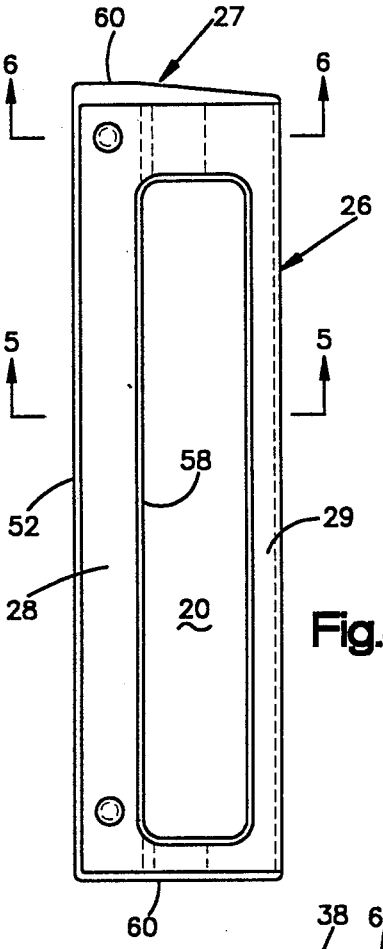
FIG. 3 is a front view of the assembled handle.

Referring to FIG. 2, the handles are assembled from two parts, namely, a sheet metal stamping 26 and a molded plastic part 27. The metal stamping provides a mounting flange portion 28, a U-shaped gripping portion 29, and a pair of leg portions 31 and 32. The two leg portions join the ends of the gripping portion 29 to the ends of the mounting flange portion 28 and cooperate therewith to define a hand opening 33 which, in the illustrated embodiment, is generally rectangular and elongated in a vertical direction.

Preferably, the plastic molded part 27 is formed of an ABS-type plastic and provides a mounting flange portion 36, a gripping portion 27, and a pair of laterally extending leg portion 38 and 39. In order to reduce the required amount of material needed to form the molded plastic part 27, it is provided with a recess 41 in each of the leg portions 38 and 39. Similarly, the gripping portion is formed of a relatively thin face portion 42.

A stiffening rib system 43 is provided along the face portion 42 and stiffening ribs 44 are provided across the recesses 41 to support the recess end wall 46. The stiffening rib system 43 provides lateral rib portions 47 which perform the dual function of supporting the longitudinal rib portion and also positioning the edges of the metal stamping 26 adjacent to the hand opening 20, as described in greater detail below.

The molded plastic part is formed with a recess 51 sized and shaped to receive the entire metal stamping 26 when the two parts are assembled prior to installation on a refrigerator. Surrounding the entire recess is an outer shoulder or wall 52. Such wall 52 includes a longitudinal portion 53 extending along the length of the mounting flange portion 36 and lateral portions 54 which extend from the portion 53 along the legs, around the outer ends at 56 and back along the back side of the gripping portions 57 and legs as illustrated in FIG. 4.

In addition, the molded part provides an inner framing shoulder 58 which extends along the recess around a hand opening 20 in the molded plastic part 27. This framing shoulder is sized to fit into the hand opening 33 in the metal stamping and extends to a position flush with the outer surface of the metal stamping when the two pieces are assembled. The edge 61 of the metal stamping extending around the opening 31 is completely concealed by the framing shoulder 58 when the two parts are assembled together.

Figure 4:
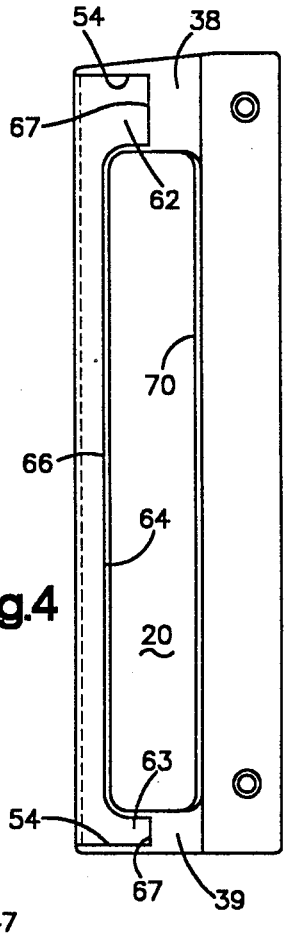
FIG. 4 is a back view of the assembled handle.
Figure 6:
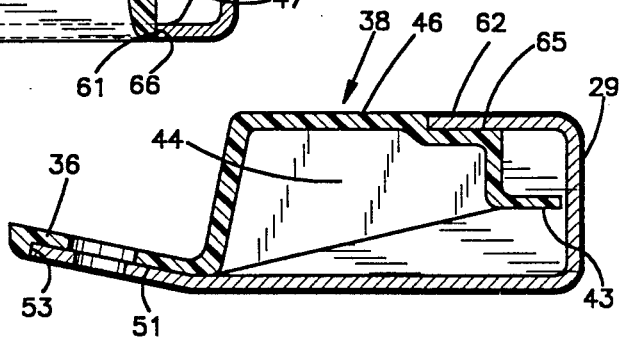
FIG. 6 is a cross section taken generally along line 6—6 of FIG. 3.

As best illustrated in FIGS. 4 and 6, the metal stamping is provided with inturned ends 62 and 63 which extend, respectively, along the back side of the legs 38 and 39. Between the inturned ends 62 and 63, the metal stamping provides an edge portion 64 which defines a portion of the hand opening 20. Here again, a shoulder or wall 66 extends along the edge 64 of the stamping. The recess also provides shoulders or walls 67 which enclose the inturned ends 62 and 63. With this structure, all of the edges of the metal stamping are obscured by mating engaging shoulder or wall surfaces on the molded plastic part. Further, the recess is proportioned so that the exterior or exposed surface of the metal stamping does not extend above the surface of the molded plastic part. Therefore, the user cannot be injured by contact with any sharp edges which might exist along the edges of the metal stamping. The ends 60 of the plastic part form the ends of the handle.

In practice, the metal stamping is provided with a surface color which contrasts with the surface color of the exposed portion of the molded plastic part. With such color contrasting, an aesthetically pleasing border appearance is provided entirely around the metal stamping. Such border extends entirely around the front side of the gripping opening. On the back side of the gripping opening, a similar appearance is provided by shoulder 66 and a lateral shelf 70 along the flange portion 36. Such shelf 70 also provides additional strength and stiffness to the flange portion 36.

In the illustrated embodiment, the metal stamping is formed of a sheet metal which is clad on both surfaces with a vinyl plastic laminate. The blanks for the metal stampings are produced by shearing the blanks required from the sheet material, and the blanks are then bent to the required shape. Since the metal forming the stamping is precoated, the shearing operation to form the blank leaves an uncoated and raw edge on the metal. This does not present a problem, however, since the shoulders of the plastic molded part completely obscure the edges and prevent the user from contact with such edges.

Figure 5:
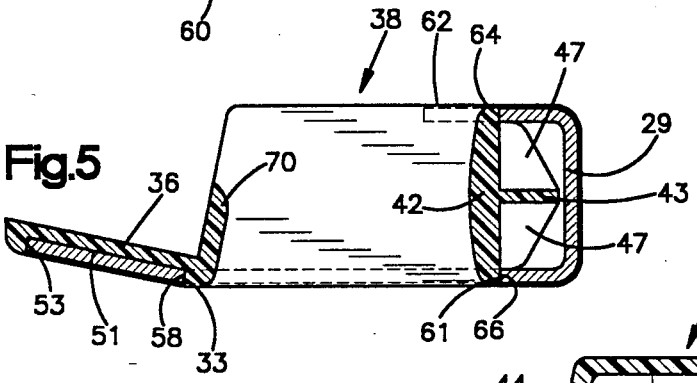
FIG. 5 is a cross section taken generally along line 5—5 of FIG. 3.

The two flange portions 28 and 36 are formed with spaced openings 66A and 67A through which the fasteners 23 are inserted when the handles are mounted on a door. Since the fasteners extend through both of the flanges, they also positively maintain the interconnection between the two handle parts. However, prior to mounting the handles, the handle parts snap together and the framing shoulder 58, which extends through the hand opening 33, mechanically locks the two parts together. As illustrated in FIGS. 5 and 6, the inturned ends 62 and 63 engage a shoulder 65 on the back side of the plastic part opposite the opening 33. Such engagement maintains the opening 33 in the metal part in position around the shoulder 58. The metal stamping is preferably formed so that the U-shaped gripping portion 29 is spread from its unstressed shape when the two parts are assembled. This ensures that the front side of the metal stamping moves into the mating recess when the parts are assembled.

As best illustrated in FIG. 5, the edges 61 and 64 on the U-shaped gripping portion 29 are positioned along the outer edges of the face portion 42 by lateral ribs 47 so that the face portion is supported throughout its length by the metal stamping. In effect, the metal stamping provides strength and rigidity to the handle and the molded plastic part provides the bulk and smooth, attractive appearance. Because the metal mounting flange portion of the metal stamping is spaced from the surface 21 of the door, a metal-to-metal contact is avoided and the tendency for damage to the finish of the parts is substantially reduced.

With this invention, a low-cost, easily manufactured, attractive and durable handle is provided which can be easily installed on the doors of an appliance with two conventional screw-type fasteners. The two parts of the handle assembly are assembled by merely snapping the two parts together and, once assembled, the two parts provide a unitary structure which can be easily handled and stored prior to installation. Further, the handles can be easily installed with a minimum of labor content.

Although the preferred embodiment of this invention has been shown and described, it should be understood that various modifications and rearrangements of the parts may be resorted to without departing from the scope of the invention as disclosed and claimed herein.

What is claimed is:

1. An appliance handle consisting only of a one-piece sheet metal stamping and a one-piece molded plastic part, said plastic part and stamping:

(a) each providing a mounting flange portion, said flange portions cooperating to provide a mounting flange assembly adapted to be mounted on an appliance surface with fasteners;

(b) cooperating to provide an elongated gripping section and a pair of legs extending laterally from the ends of said gripping section;

said mounting flange assembly cooperating with said legs and gripping section to define and enclose a hand opening, said plastic part flange portion spacing said metal stamping flange portion from said appliance surface when said handle is mounted on said appliance and preventing said metal stamping from contacting said appliance surface, said metal stamping providing a generally U-shaped portion defining three sides of said gripping section, said stamping opening surrounding said hand opening, said plastic part providing a recess in which said stamping is positioned and shoulder means mating continuously along all of the edges of said stamping, said shoulder means providing a surface surrounding said stamping substantially flush with said edges of said stamping, said shoulder means extending along said stamping opening cooperating with said U-shaped portion to interlock said plastic part and said stamping together.

2. An appliance handle as set forth in claim 1, wherein said metal stamping is formed of precoated metal and has uncoated edges.

3. An appliance handle as set forth in claim 1, wherein said plastic part and said stamping provide contrasting colors, and said plastic part provides a contrasting border completely around the edges of said stamping.

4. An appliance handle as set forth in claim 1, wherein said molded part includes a shoulder engaging the edge of said opening in said metal stamping remote from said U-shaped portion and cooperating therewith to maintain said metal stamping and said molded part connected together.

5. An appliance comprising a cabinet, a metal door on said cabinet, and a door handle mounted on said door by at least two fasteners, said door handle consisting only of a one-piece sheet metal stamping and a one-piece molded plastic part, said stamping and plastic part;

(a) each providing a mounting flange portion, said flange portions cooperating to provide a mounting flange assembly adapted to be mounted on an appliance surface with fasteners;

(b) cooperating to provide an elongated gripping section and a pair of legs extending laterally from the ends of said gripping section;

said mounting flange assembly cooperating with said legs and gripping section to define and enclose a hand opening, said plastic part flange portion spacing said metal stamping flange portion from said appliance surface when said handle is mounted on said appliance and preventing said metal stamping from contacting said appliance surface, said metal stamping providing a generally U-shaped portion defining three sides of said gripping section, said stamping opening surrounding said hand opening, said plastic part providing a recess in which said stamping is positioned and shoulder means mating continuously along all of the edges of said stamping, said shoulder means providing a surface surrounding said stamping substantially flush with said edges of said stamping, said shoulder means extending along said stamping opening cooperating with said U-shaped portion to interlock said plastic part and said stamping together.

* * * * *